US008956196B2

(12) United States Patent
Rickenbach et al.

(10) Patent No.: US 8,956,196 B2
(45) Date of Patent: Feb. 17, 2015

(54) MINI-SHOWER BATH TOY FOR SINGLE-HANDED ADULT USE AND DOUBLE-HANDED CHILD PLAY

(76) Inventors: Johanna Rickenbach, Zurich (CH); Alex Hochstrasser, Zurich (CH)

( * ) Notice: Subject to any disclaimer, the term of this patent is extended or adjusted under 35 U.S.C. 154(b) by 246 days.

(21) Appl. No.: 13/374,795

(22) Filed: Jan. 13, 2012

(65) Prior Publication Data

US 2012/0214381 A1 Aug. 23, 2012

Related U.S. Application Data

(60) Provisional application No. 61/461,188, filed on Jan. 13, 2011.

(51) Int. Cl.
*A63H 23/10* (2006.01)

(52) U.S. Cl.
CPC ..... *A63H 23/10* (2013.01)
USPC ..... 446/153

(58) Field of Classification Search
CPC ..... A63H 23/00; A63H 23/10; A63H 33/00; B05B 1/18
USPC ..... 446/153, 267, 475, 491; 4/615, 616, 4/617; 141/18
See application file for complete search history.

(56) References Cited

U.S. PATENT DOCUMENTS 1,473,104 A * 11/1923 Jurgensen ..... 141/18
1,507,814 A * 9/1924 Cooley ..... 141/18
2,477,863 A * 8/1949 Copeman ..... 141/18
4,078,792 A * 3/1978 Arato ..... 472/137
2003/0042332 A1* 3/2003 Lai ..... 239/446
2011/0094450 A1* 4/2011 Chamberlain ..... 119/72

FOREIGN PATENT DOCUMENTS

GB 2235881 A * 3/1991

OTHER PUBLICATIONS

Old and Interesting, "Watering Floors and Gardens in Medieval Times, and Later", Jul. 3, 2009, pp. 1-3, <http://www.oldandinterestic.com/medieval-watering-pot.aspx>.*
Old and Interestin,. "Watering Floors and Gardens in Medieval Times, and Later", Jul. 3, 2009, pp. 1-3, <http://www.oldandinterestic.com/medieval-watering-pot.aspx>.*
(Continued)

*Primary Examiner* — Gene Kim
*Assistant Examiner* — Alyssa Hylinski
(74) *Attorney, Agent, or Firm* — Integral Patent; Laurence J. Shaw

(57) ABSTRACT

A bath apparatus for play and/or bathing having a reservoir, a plurality of substantially co-planar bottom release holes, and a top control aperture. Upon submerging the bath toy, water flows into the reservoir through the release holes as air escapes through the control aperture. When the control aperture is sealed with a thumb or finger and the toy is raised from the water, water in the reservoir is retained in the reservoir. When the control aperture is unsealed, water in the reservoir flows out through the release holes. The control aperture is offset from the top of the reservoir by approximately 12° to be ergonomically located and oriented to allow a thumb to produce an airtight seal when the reservoir is held in a single adult-size hand, or to allow a finger to produce an airtight seal when the reservoir is held by child-size hands in both hands.

4 Claims, 7 Drawing Sheets

(56) References Cited

OTHER PUBLICATIONS

Thumb Pot Waterer, fromfarmtomarket.com, Woodbury, CT, https://www.fromfarmtomarket.com/p-63-thumb-pot-waterer.aspx, p. 1, Dec. 11, 2008.

Thumb Waterer, amazon.com, Seattle, WA, http://www.amazon.co.uk/ Thumb-Waterer-Terracotta-ideal-Gardening/dp/B003044Q6C, p. 1, May 15, 2008.

Thumb Pot Waterer, wmpot.co.uk, Notts, England, http://wmpot.co.uk/store/comersus_viewItem.asp?idProduct=174, pp. 1-2, Nov. 11, 2010.

* cited by examiner 100
110
120
125
130
135

θ
123
127
140

MINI-SHOWER BATH TOY FOR SINGLE-HANDED ADULT USE AND DOUBLE-HANDED CHILD PLAY

RELATED APPLICATIONS

The present application is related to and claims the priority of provisional patent application Ser. No. 61/461,188 filed Jan. 13, 2011 by the same inventors and having the same title.

FIELD OF THE INVENTION

The present invention is directed to bath toys and bathing tools. More particularly, the present invention is directed to bath apparatuses for single-handed adult use (where use may include play) and double-handed child play. Furthermore, the present invention is directed to bath toys where principles of air pressure effects and fluid statics and dynamics are utilized and illustrated. Furthermore, the present invention is directed to tools useful for bathing children. The present invention is also directed to a body with an aperture ergonomically designed for single handed, adult-size hand use to allow a thumb to provide an air-tight seal. Furthermore, the present invention is directed to a bath/bathing apparatus with an aperture ergonomically designed for double-handed, child-size hand use to allow a finger to provide an air-tight seal.

BACKGROUND OF THE INVENTION

The field of toys and particularly bath toys is crowded and has a long history. A comprehensive survey of bath toys similar to that of the present invention is not attempted here. However, it should be noted that the toy of the present invention allows water to be held in a reservoir by sealing a top control aperture with a finger or the thumb where the seal required to retain water within the reservoir must be airtight. With even a small deviation from airtightness, water is not retained in the reservoir. The toy of the present invention is designed to allow an airtight seal to be created and maintained with the thumb of an adult-size hand while the toy is held in a single hand, or sealed with a finger when the toy is held in both hands of child-size hands.

Furthermore, the present invention provides an apparatus which can be used as a bathing tool, as well as a toy. Children are typically rinsed in a bath by the adult splashing with a hand, or by the adult cupping water in the hand and pouring it on the child, or by squeezing water from a wash cloth onto the child, or by pouring water from a cup or bowl onto the child. Advantages of the bathing apparatus of the present invention include that (i) rinsing is more easily controlled than by splashing, (ii) more water can be held in the reservoir of the apparatus than in a cupped hand or a wash cloth, (iii) water flow is more easily controlled than by splashing, and (iv) water flow is more easily controlled and can be made to last longer than by pouring from a cup.

It is an object of the present invention to provide a bath toy.

It is another object of the present invention to provide a bath toy which demonstrates physical principles, including pressure effects and fluid statics and dynamics.

More particularly, it is another object of the present invention to provide a bath apparatus which can retain and release water.

It is another object of the present invention to provide a bath toy which is easily operable by the small hands of children.

It is another object of the present invention to provide a bath apparatus which is easily operable by a single adult hand.

It is another object of the present invention to maximize the amount of water retainable in the bath apparatus while still allowing it to be easily operable by a single adult hand or a pair of child-size hands.

It is another object of the present invention to provide a bath apparatus/toy which retains and releases water having one or more control apertures ergonomically located for both small and large hands.

More particularly, it is an object of the present invention to provide a bath apparatus which retains and releases water in a reservoir by sealing and unsealing, respectively, a control aperture ergonomically located and oriented to allow it to be operated by the thumb while the reservoir is held in the palm of an adult-size hand.

Also more particularly, it is an object of the present invention to provide a bath toy which retains and releases water in a reservoir by sealing and unsealing, respectively, a control aperture ergonomically located and oriented to allow it to be operated by a finger while the reservoir is held in both hands of child-size hands.

Furthermore, it is an object of the present invention to provide a bath apparatus which can be held in a single hand and which retains and releases water of maximal volume.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

SUMMARY OF THE PRESENT INVENTION

The present invention is directed to a toy having a reservoir for retaining water, a plurality of release holes along the bottom of the reservoir through which water can pass into and out of said reservoir, and a control aperture near the top of said reservoir through which air can pass. The control aperture is sealable with a finger or thumb. When the control aperture is sealed, water within the reservoir is retained due to the reduced air pressure within the reservoir relative to the exterior air pressure. When the control aperture is not sealed, water can drain from the release holes due to air flow through the control aperture. The control aperture is offset from a vertical through the center of the reservoir by an offset angle $\theta$ as measured from the center of the reservoir of between 5° and 20°.

The present invention is also directed to a toy having a reservoir with a substantially convex exterior surface, a plurality of downward protrusions along the bottom of the reservoir with each of the downward protrusions having a release hole near an apex thereof, and an upwards protrusion near the top of the reservoir having a control aperture at an apex thereof, the control aperture being above the top of the reservoir. The release holes are essentially coplanar, defining a bottom horizontal plane below the bottom of the reservoir. The upwards protrusion with the control aperture is offset at an angle $\theta$, as measured from the center of the reservoir, from a vertical. In addition, the control aperture has an orientation which is at roughly the same angle $\theta$ from vertical.

The present invention is also directed to an apparatus for bathing a child. The apparatus has a substantially spherical reservoir having a diameter of between 7.5 cm and 14 cm for retaining water, a plurality of release holes along the bottom of the reservoir through which water can pass, and a control aperture near the top of the reservoir through which air can pass. The control aperture is sealable with a digit of a hand and when the control aperture is sealed, reduced air pressure within the reservoir relative to exterior air pressure results in the water within the reservoir being retained. When the control aperture is not sealed, water within the reservoir drains from the release holes due to air flow through said control aperture.

BRIEF DESCRIPTION OF THE DRAWINGS

The accompanying figures, which are incorporated in and form a part of this specification, illustrate embodiments of the invention and, together with the description given above and the detailed description of the preferred embodiments given below, serve to explain the principles of the invention.

FIG. 6A shows the toy of the first embodiment with the top protrusion pushed in.

FIG. 6B shows the toy of the first embodiment with neither the top nor the bottom protrusions folded in.

FIG. 6C shows the toy of the first embodiment with the bottom protrusions folded in.

DETAILED DESCRIPTION OF THE PREFERRED EMBODIMENTS

Figures 1A, 1B, 1C:
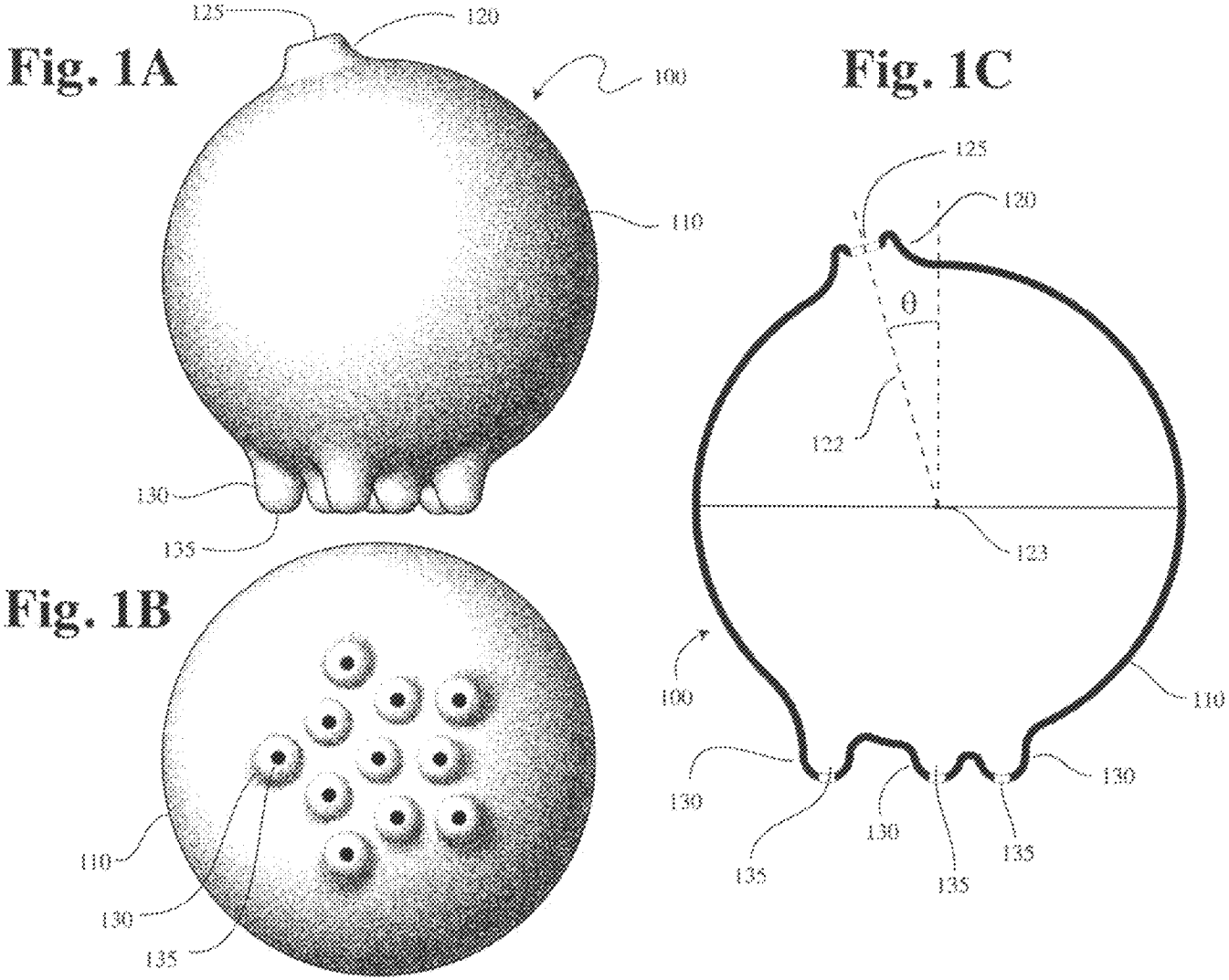
FIG. 1A shows a side view of a preferred embodiment of the bath toy of the present invention.
FIG. 1B shows a bottom view of the bath toy of FIG. 1A.
FIG. 1C shows a cross-sectional view of the bath toy of FIG. 1A.

As shown in FIGS. 1A, 1B and 1C, a first preferred embodiment of the bath toy (100) of the present invention has a hollow reservoir (110) with an upwards protrusion (120) near the top and a number of downward protrusions (135) on the bottom. The reservoir (110) is convex along both principal axes of curvature, i.e., doubly convex, and preferably the reservoir (110) is substantially spherical. The top protrusion (120) has a control aperture (125) at its apex, and each of the downward protrusions (130) has a release hole (135) near its apex. ("Hole" is used synonymously with "aperture" in the present specification and claims.) The upwards and downward protrusions (120) and (130) allow the orientation of the toy (100) to be determined tactilely. (In the present specification and claims the orientation of the toy (100) as shown in FIGS. 1A, 1C, 2A, 3A, 3B, 3C, 4A, 5A and 5B with the release holes (125) at the bottom is assumed unless otherwise specified.) The height of the top protrusion (120) is sufficient to make the control aperture (125) the highest point within the interior of the toy (100). The apexes of the downward protrusions (130) are essentially co-planar, so the downward protrusions (130) can act as feet and the toy (100) can be set in a stable equilibrium on a planar surface such as a counter top or floor. The downward protrusions (130) have lengths such that their bottoms are below the bottom of the reservoir (110). The contour of the bottom of the reservoir (110) and the downward protrusions (130) is such that water completely drains from the reservoir (110), thereby providing the hygienic advantage that mold does not grow within the toy (100). Furthermore, the upwards and downward protrusions (120) and (130) have smooth, organic contours to allow relatively non-turbulent fluid flows through them (125) and (130).

Figure 1E:
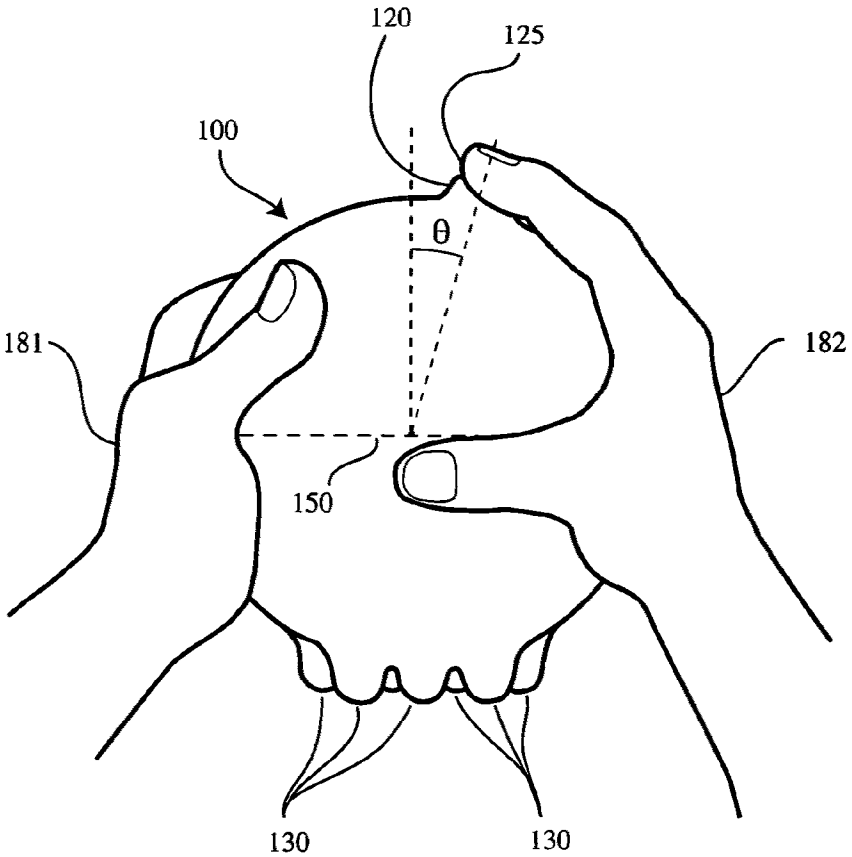
FIG. 1E shows the bath toy of FIG. 1A held in a pair of child-size hands with the control aperture being sealed by a finger.
Figure 1D:
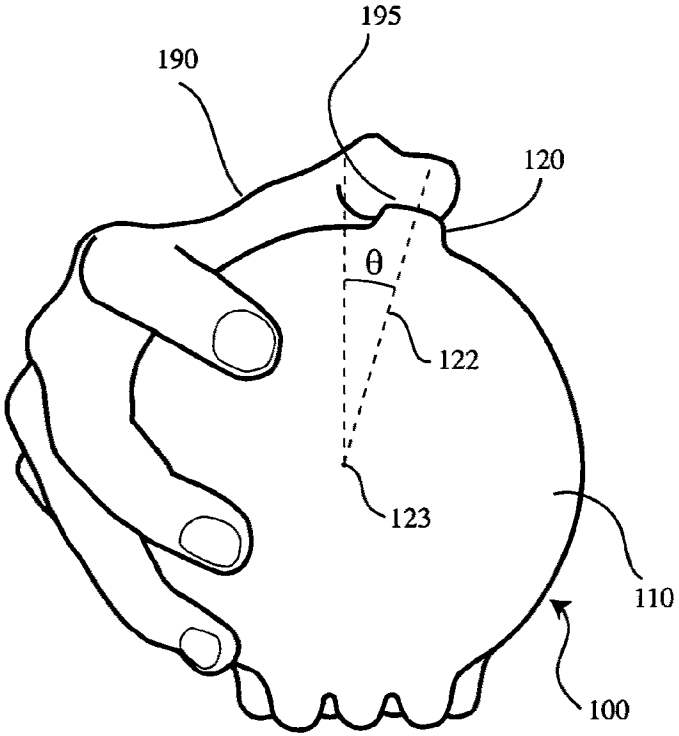
FIG. 1D shows the bath toy of FIG. 1A with the control aperture sealed by the thumb of an adult-size hand.

The specific gravity of water is 1 g/cc and a hand can comfortably hold a sphere of water having a diameter up to roughly 130% the height of the palm. According to the present invention, the position and orientation of the control aperture (125) allows it to be readily plugged with a thumb when the toy (100) is held in the palm of an adult-size hand. This is possible because for a variety of sizes of adult-size hands, the face of the first phalange of the thumb is substantially oriented towards the center of the region within the palm as the grip of the hand closes. As shown in FIG. 1D, when the toy (100) is held in a normal adult hand, the face (195) of the thumb (190) is generally at angle θ of between 5° and 20° from vertical. Therefore, according to the present invention the top protrusion (120) is displaced from the top of the toy (100) by an angle θ, measured from the center (123) of the reservoir (110), of between 5° and 20°, still more preferably between 10° and 15°, and most preferably approximately 12°. Furthermore, according to the present invention the orientation of the upwards protrusion (120) is such that its central longitudinal axis (122) roughly passes through the center (123) of the reservoir (110) and has an angle θ, measured from the center (123) of the reservoir (110), of between 5° and 20°, still more preferably between 10° and 15°, and most preferably approximately 12°. Furthermore, according to the present invention the orientation of the control aperture (125) is such that its central axis (122) roughly passes through the center (123) of the reservoir (110) and has an angle θ, measured from the center (123) of the reservoir (110), of between 5° and 20°, still more preferably between 10° and 15°, and most preferably approximately 12°.

Furthermore, according to the present invention the position and orientation of the control aperture (125) allows it to be readily plugged with a finger when the toy (100) is held by a child in both hands (181) and (182). As is shown in FIG. 1E, a child will generally need to support the toy (100) holding it (100) with the equator (150) above the center of each palm. According to the preferred embodiment of the present invention, the distance from the equator (150) to the control aperture is preferably between 37 mm and 70 mm, more preferably between 47 mm and 60 mm, and most preferably about 54 mm, thereby allowing a pair of child-size hands to support the reservoir (100) and seal the control aperture (125). The above distance ranges roughly correspond to the ranges in the diameter of the reservoir (110) specified in the paragraph directly below.

The control aperture (125) and the bottom holes (135) are large enough that air and water can readily flow through them (125) and (135). The control aperture (125) is small enough that it can be plugged with the tip of a child's or adult's finger or thumb. Furthermore, the release holes (135) are close enough together that they (135) may all be plugged with a child's or adult's palm. Preferably, according to the preferred embodiment the toy (100) has a width of 60 to 125 mm, the release holes (135) have a diameter of 1.5 to 5 mm, and the control aperture (125) has a diameter of 2.5 to 10 mm. More preferably, according to the preferred embodiment the toy (100) has a width of 75 to 95 mm, the release holes (135) have a diameter of 2 to 4 mm, and the control aperture (125) has a diameter of 3.5 to 7.5 mm. Most preferably, according to the preferred embodiment the toy (100) has a width of 85 mm, the release holes (135) have a diameter of 3 mm, and the control aperture (125) has a diameter of 5.65 mm.

Based on the fluid dynamics of air and water, and more particularly the viscosities of air and water, to insure that (i) the reservoir (110) can readily be filled when the toy (100) is submerged and (ii) will drain rapidly enough to provide an aesthetically pleasing and useful shower from the release holes (135) when the control aperture (125) is unsealed, the sum of the areas of the release holes (135) is preferably 3 to 12 times the area of the control aperture (125), more preferably the sum of the areas of the release holes (135) is 4.5 to 9 times the area of the control aperture (125), and most preferably the sum of the areas of the release holes (135) is roughly 6 times the area of the control aperture (125).

Use of the Bath Toy

Figure 3C:
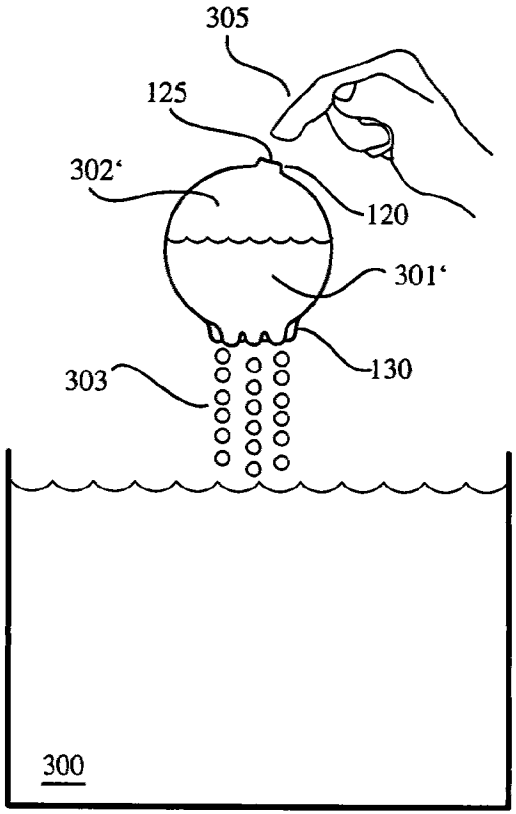
FIG. 3C shows a third stage in the use of the bath toy of FIGS. 1A, 1B and 1C.
Figure 3B:
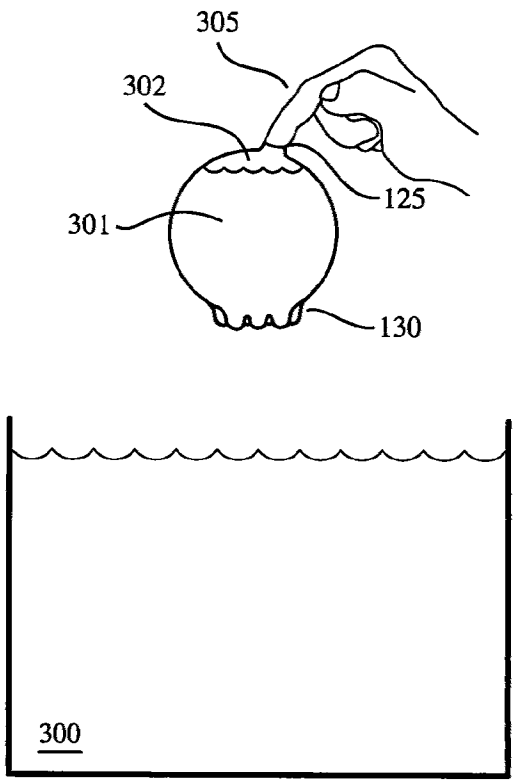
FIG. 3B shows a second stage in the use of the bath toy of FIGS. 1A, 1B and 1C.
Figure 3A:
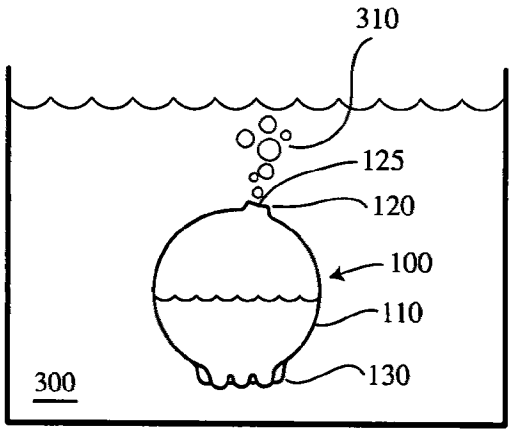
FIG. 3A shows a first stage in the use of the bath toy of FIGS. 1A, 1B and 1C.

FIGS. 3A, 3B and 3C show the use of the first preferred embodiment of the toy (100). (The other preferred embodiments described below are used in essentially the same manner.) The toy (100) is used by first submerging it (100) in water (300), as shown in FIG. 3A. Air (310) escapes through the control aperture (125) as water enters the toy (100) through the release holes (135) due to water pressures resulting from gravity. (Alternately, the toy (200) may be submerged at another orientation, such as with the bottom holes (230) upwards. However, at some orientations the toy (200) will not be completely filled with water when submerged.)

Once the reservoir (110) is filled to the desired extent with water, the control aperture (125) is covered firmly and completely with a finger (305) to provide an airtight seal of the control aperture (125), and the toy (100) lifted out of the water (300), as shown in FIG. 3B. Water (301) is retained inside the toy (100) by low air pressure, relative to the ambient air pressure, at the top of the retained water (301). Although a substantial pocket of air (302) is depicted between the finger (305) and the top of the retained water (301), the air pocket (302) can be quite small and even essentially non-existent. It is important to note that a completely air-tight seal of the top aperture (120) is required to retain the water (301). Therefore, as discussed above, it is crucial that the top hole (120) be positioned and oriented in a way that it makes such a seal readily possible/available.

When the toy (100) is lifted out of the water (300) and the finger (305) is removed, as shown in FIG. 3C, air can flow into the control aperture (125), allowing the retained water (301') to flow out of the toy (100) through the release holes (135), producing a shower (303) of water from the bottom of the toy (100). The flow out through the release holes (135) can be stopped and resumed at any time while the level of the water is above that of the highest of the release holes (135) by blocking and unblocking, respectively, the control aperture (125) with the finger (305). It should also be noted that flow of the retained water (301) through the release holes (135) can be produced while the control aperture (125) is sealed with the finger (305) by tilting the toy (100) so that there is a sufficient difference in water pressure due to height differences to overcome surface tension effects. If the diameter of the release holes (135) is increased, then a smaller tilting angle is required to produce a flow of water through the release holes (135) while the control aperture (125) is sealed. Preferably, a flow of water through the release holes (135) is produced by a tipping angle of 2° to 15°, more preferably 3° to 10°, more preferably 4° to 8°, and most preferably 5° to 7°.

Figures 6A, 6B, 6C:
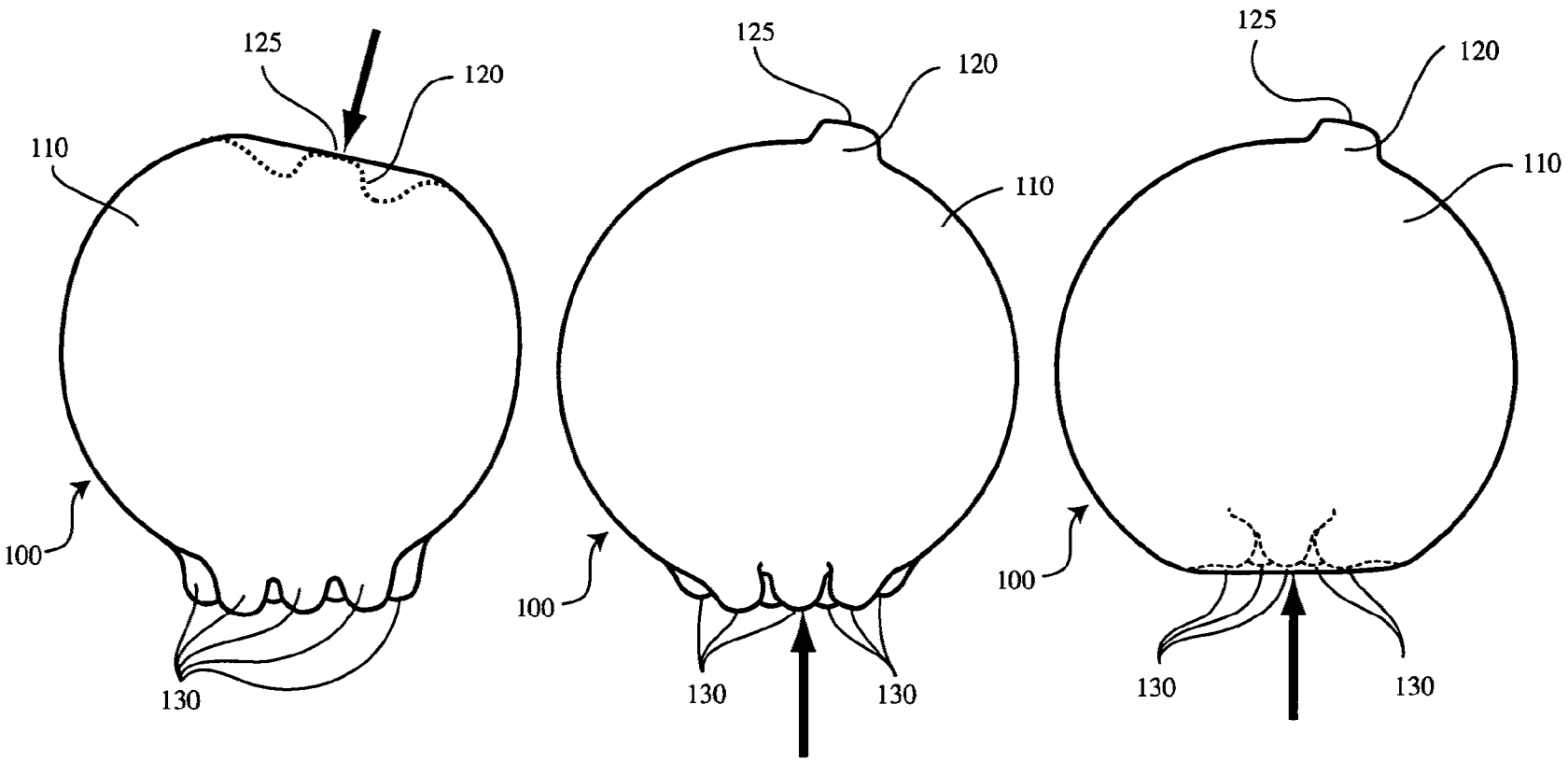

According to the preferred embodiment, the toy (100) of the present invention is made of a flexible plastic. This helps insure safety and provides additional play possibilities. As shown in FIG. 6A, the top protrusion (120) may be pushed in. Due to the structural memory of the plastic, the indented top protrusion (120) will revert to its original position. Similarly, as shown in FIGS. 6B and 6C, the bottom protrusions (130) may be folded in. Due to the structural memory of the plastic, the bottom protrusions (130) will revert to their original positions in a motion resembling the opening of a flower or sea anemone.

Alternate Preferred Embodiments

Figure 2B:
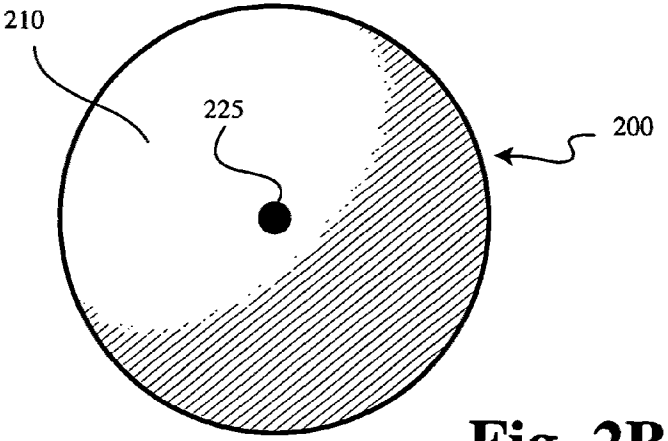
FIG. 2B shows a top view of the bath toy of FIG. 2A.
Figure 2C:
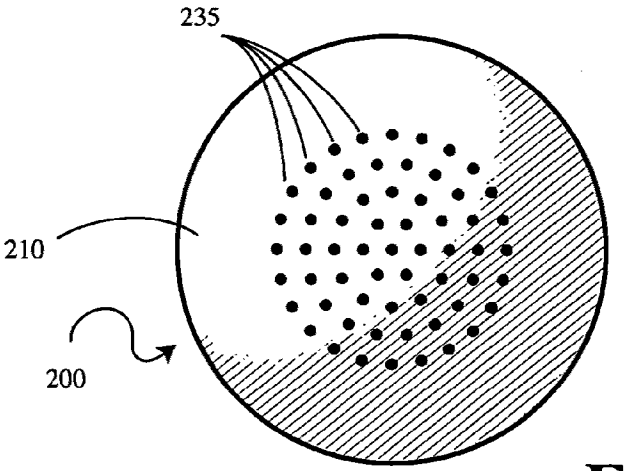
FIG. 2C shows a bottom view of the bath toy of FIG. 2A.
Figure 2A:
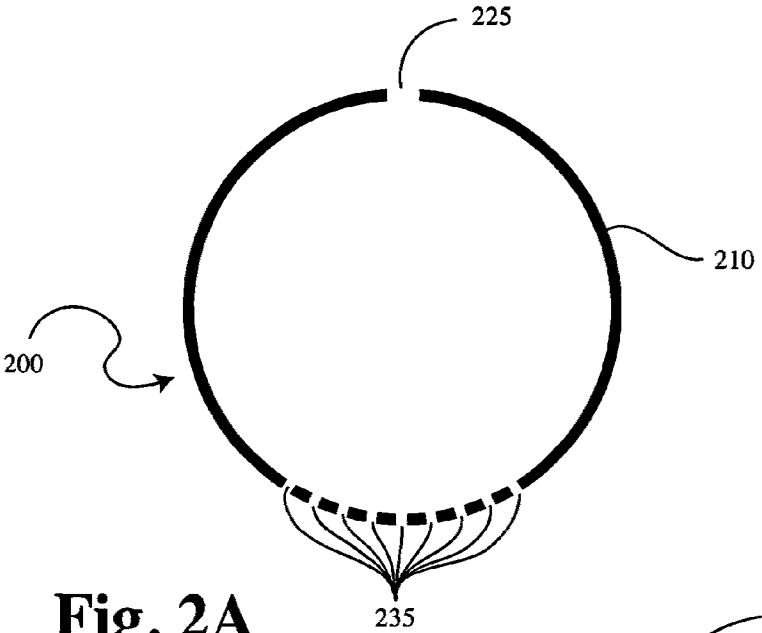
FIG. 2A shows a cross-sectional view of a second preferred embodiment of the bath toy of the present invention.

As shown in FIGS. 2A, 2B and 2C, an alternate preferred embodiment of the bath toy (200) of the present invention has a substantially spherical, hollow body (210) with a hole (225) at the top and an array of holes (235) at the bottom. The top hole (225) and the bottom holes (235) are large enough that air and water can flow through them (225) and (235). The top hole (225) is small enough that it can be plugged with the tip of a child's or adult's finger. Furthermore, a plurality of the bottom holes (235) may be plugged with a child's or adult's palm.

It should be noted that an advantage of play with the toy (100) of the first embodiment shown in FIGS. 1A, 1B and 1C is that all the release holes (135) are coplanar, so if the toy (100) is held upright so that the release holes (135) lie in a horizontal plane then there is an equal vertical distance between the control aperture (125) and the release holes (135). Therefore, the water pressure at each of the release holes (135) is equal when the toy is held upright. If the toy of the first embodiment (100) has release holes (135) of the same diameter as the diameter of the bottom holes (235) of the toy of the second embodiment (200), then a greater tilting angle is required to produce water flow from the toy of the first embodiment (100) because its release holes (135) are coplanar. This effect becomes more pronounced as the diameter of the release holes (135) and (235) is increased. Furthermore, because the release holes (135) of the toy of the first embodiment (100) are co-planar, when the toy (100) held upright and the control aperture (125) is unplugged, the water flow from each of the release holes (135) is essentially the same.

Figure 4A:
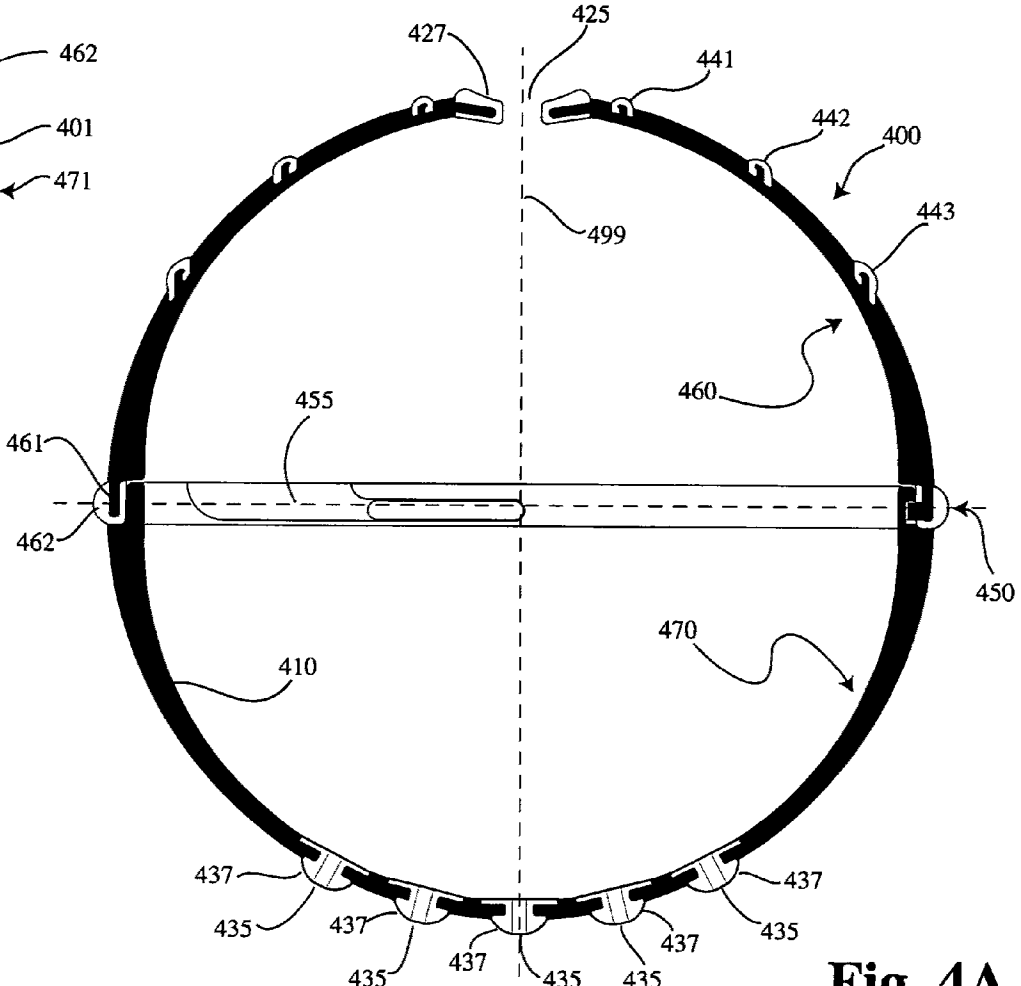
FIG. 4 shows a cross-sectional view of a third preferred embodiment of the bath toy of the present invention.
Figure 4C:
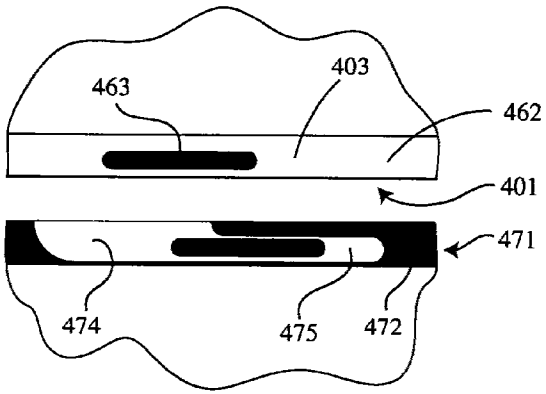
Figure 4B:
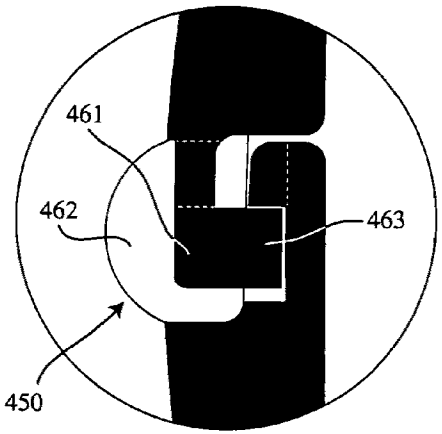

A preferred embodiment of the toy (400) of the present invention where the top and bottom halves (460) and (470) are separable is shown in FIGS. 4A and 4B. The toy (400) has a substantially spherical, hollow body (410) with an attachment mechanism (450) along the equator (455). The body (410) has a top hole (425) in a small indent at the top and an array of bottom holes (435) on the bottom. In the preferred embodiment the array of bottom holes (435) has cylindrical symmetry about the central vertical axis (499). In the top hole (425) is a rubber grommet (427), and in each bottom hole (435) is a rubber grommet (437). The rubber grommets (427) and (437) facilitate sealing of the holes (425) and (435). The top hole (425) and the bottom holes (435) are large enough that air and water can flow through them (425) and (435). The top hole (425) is small enough that it can be plugged with the tip of a child's or adult's finger, and each of the bottom holes (435) is small enough that it can be plugged with the tip of a child's or adult's finger. Furthermore, a plurality of the bottom holes (435) may be plugged with a child's or adult's palm. Three overmolded rubber rings (441), (442) and (443) oriented horizontally and centered on the central vertical axis (499) facilitate gripping/holding the toy (400). The bottom lip (461) of the top half (460) has an overmolded rubber covering (462) and two or three equally-spaced tongues (463) which protrudes through the rubber covering (462). The top lip (471) of the bottom half (470) has two or three equally-spaced cavities (474), and each cavity (474) has an undercut (475) which mates with a tongue (463) to provide what is commonly referred to as a "bayonet" reversible attachment mechanism (450).

Figure 5B:
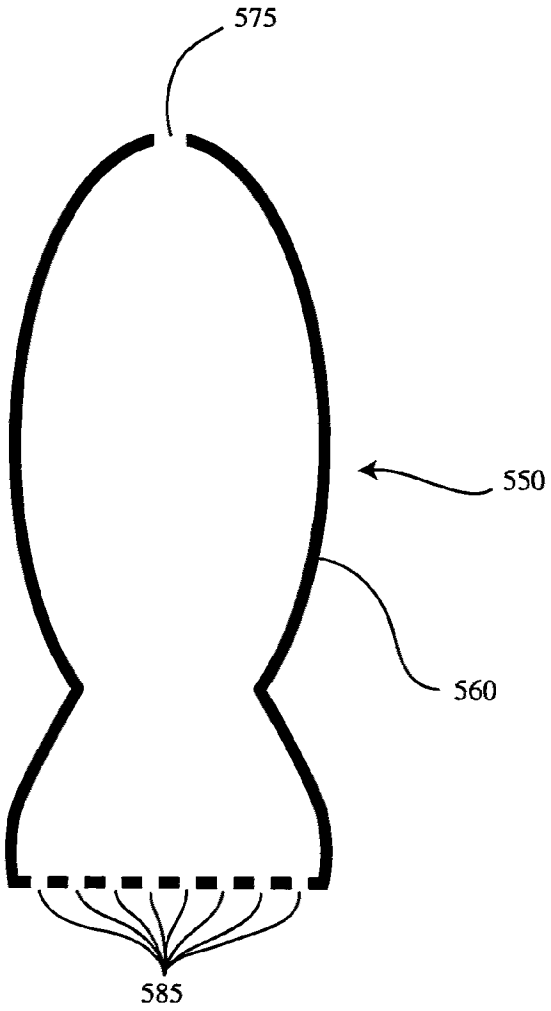
FIGS. 5A and 5B show alternative shapes for the bath toy of the present invention.
Figure 5A:
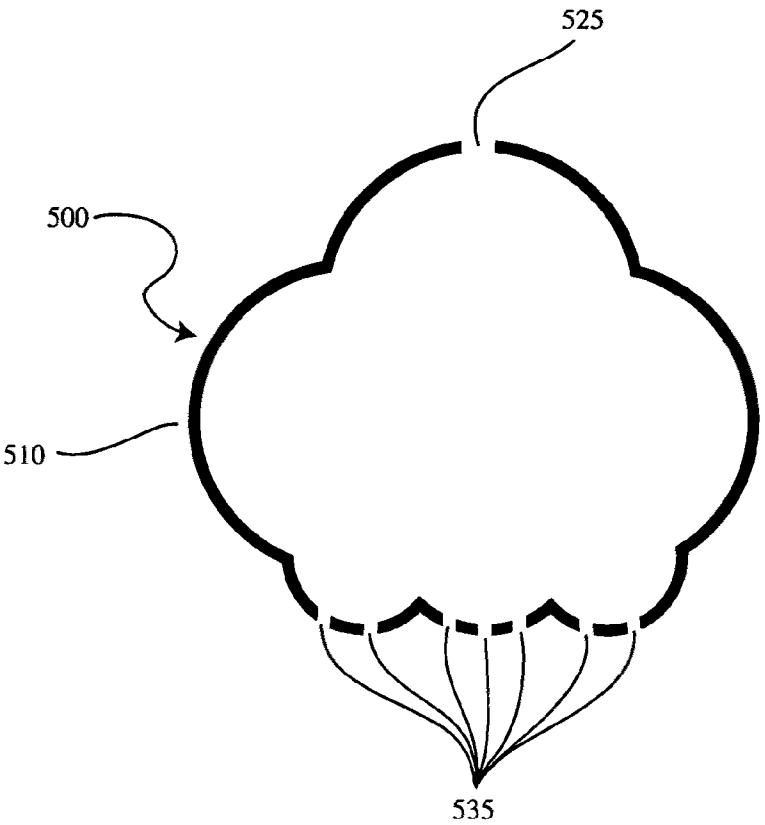

As depicted in FIGS. 5A and 5B, the body of the toy can have a fanciful or illustrative shape. For instance, the body (510) of the toy (500) shown in FIG. 5A has a top hole (525) and a plurality of bottom holes (535) and has the shape of a cloud, and the body (560) of the toy (550) shown in FIG. 5B has a top hole (575) and a plurality of bottom holes (585) and has the shape of a rocket.

Thus, it will be seen that the improvements presented herein are consistent with the objects of the invention for a bath toy. While the above description contains many specificities, these should not be construed as limitations on the scope of the invention, but rather as exemplifications of preferred embodiments thereof. Many other variations are within the scope of the present invention. For instance: the toy may be played with or used with two hands by an adult or one hand by a child; the toy may be used in a body of water other than a bath, such as a hot tub or a pond, lake or river; the toy may be used with a liquid other than water; the toy may have a shape other than those shown; the toy may have more than one hole on top, i.e., more than one control aperture; the toy may have more or fewer holes on the bottom; the sizes of the holes may differ from those shown—smaller holes on the bottom prolong the shower effect and result in finer jets of water, while larger holes provide quicker filling of the toy and stronger jets of showering water; the size of the toy may be other than described—for instance, a miniature version may be around 3 cm to 6 cm, and more preferably around 4 cm, in diameter; the sizes of the holes at the bottom may differ; some or all of the bottom holes may be indented in, rather than protruding from, the bottom surface; the holes may be displaced from the apexes of the protrusions; the downward protrusions may be vertical or oriented off from vertical; the holes may be located other than where shown above—for instance, there may be one or more side holes, or the control aperture may be at the top of reservoir, i.e., the offset angle may be zero or less than the ranges claimed; the reservoir may not be substantially spherical, and may for example be an ellipsoid of revolution, or even a shape where the curvature along both principal axes is not positive; the outside surface may be textured or may have ribbing; another type of attachment mechanism may be used to removably attach or non-removably attach the top and bottom halves; etc. Furthermore, the description of the physical principles underlying the operation and performance of the present invention may include approximations, simplifications and assumptions and are not intended to be limiting. Furthermore, the toy may be played with in many ways other than that described. For instance: some of the bottom holes may be blocked or plugged when letting the water flow out of the toy; the toy may be held in an orientation other than what is shown, for instance it may inverted from what is shown in the figures so that the bottom holes are at the top of the body and the top hole is at the bottom of the body (in which case the bottom holes would need to be blocked to retain water in the toy); the toy may be used with other liquids, or with gels; etc. Accordingly, it is intended that the scope of the invention be determined not by the embodiments illustrated or the physical analyses motivating the illustrated embodiments, but rather by the appended claims and their legal equivalents.

What is claimed is:

1. A bath apparatus comprising a reservoir for retaining water, a plurality of release holes along the bottom of said reservoir through which water can pass into and out of said reservoir, said release holes being essentially coplanar and defining a bottom horizontal plane, and a control aperture near the top of said reservoir through which air can pass, said control aperture being sealable with a single digit of a hand, and when said control aperture is sealed, reduced air pressure within said reservoir relative to exterior air pressure results in retention of water within said reservoir, and when said control aperture is not sealed, water drains from said release holes due to air flow through said control aperture, said reservoir having a diameter of between 60 and 125 mm and an interior volume between 250 and 400 cubic centimeters, said control aperture being offset from a vertical through a center of said reservoir by an offset angle θ measured from said center of said reservoir of between 5° and 20° , so said bath apparatus may be operated with two hands by a child with an equator of said reservoir above the center of each palm of said two hands and said single digit of said hand being a finger, and said reservoir may be operated in a single adult-size hand with said single digit of said hand being a thumb.

2. The bath apparatus of claim 1 wherein said offset angle θ is between 10° and 15° , said diameter of said reservoir is between 75 and 95 mm, and said interior volume is between 300 and 350 cubic centimeters.

3. The bath apparatus of claim 1 wherein said reservoir has a substantially doubly convex exterior.

4. The bath apparatus of claim 1 wherein said control aperture is on an upwards protrosion and said upwards protrusion has an orientation which is at substantially said offset angle θ from vertical.

* * * * *